United States Patent [19]

Wedman

[11] 4,228,766

[45] Oct. 21, 1980

[54] TRUCK MOUNTED CATTLE CONTROL BOX

[76] Inventor: Martin Wedman, Gen. Del., New Fish Creek, Alberta, Canada

[21] Appl. No.: 12,608

[22] Filed: Feb. 16, 1979

[30] Foreign Application Priority Data

Feb. 17, 1978 [CA] Canada ..... 297353

[51] Int. Cl.[3] ..... A61D 3/00

[52] U.S. Cl. ..... 119/103

[58] Field of Search ..... 119/103, 99, 98

[56] References Cited

U.S. PATENT DOCUMENTS

| | | | |
|---|---|---|---|
| 2,396,928 | 3/1946 | Parsons | 119/99 |
| 2,674,980 | 4/1954 | Bentley | 119/103 |
| 2,967,510 | 1/1961 | Stoody | 119/103 |
| 3,590,784 | 7/1971 | Fly | 119/103 |

FOREIGN PATENT DOCUMENTS

| | | | |
|---|---|---|---|
| 784278 | 10/1957 | United Kingdom | 119/103 |

*Primary Examiner*—Hugh R. Chamblee

*Attorney, Agent, or Firm*—Stanley G. Ade

[57] ABSTRACT

A cattle control box is mounted upon a small two wheeled trailer that can be towed by a tractor, truck or the like. The box is pivotally secured or mounted upon the axle and a hand operated fluid operator extends between the front of the trailer and one side of the box so that the box can be placed in a vertical position with the base on the ground whereupon an animal can be placed in or removed from the box, and the box can then be rotated upon the axle through approximately 90° so that it is lying on its side with the animal held firmly in the box for treatment. The upper side of the box, when in the last mentioned position, includes an upper and lower gate for access to the animal. A head squeeze gate is provided at one end to hold the animal and also to release it after treatment and belts or the like are provided within the box to raise and hold the animal within the box.

8 Claims, 13 Drawing Figures

TRUCK MOUNTED CATTLE CONTROL BOX

BACKGROUND OF THE INVENTION

This invention relates to new and useful improvements in animal control box assemblies.

Conventionally, animal squeeze or control boxes or cattle chutes either consist of relatively large involved stationary units as exemplified by Canadian Pat. No. 314,111 or, if mobile, are situated in an upright or vertical position and cannot be rotated through approximately 90° in order to facilitate the treatment of animals.

SUMMARY OF THE INVENTION

The present invention overcomes these disadvantages by providing a relatively simple lightweight trailer having a control box or cattle chute mounted thereon which can readily be moved from a vertical position to a horizontal position and vice-versa.

One aspect of the invention includes an animal control box assembly or cattle chute mounted upon a wheeled trailer. The trailer includes a frame with a hitch on the front end so that it can be towed behind a truck, car or tractor and a control box or cattle chute is pivotally mounted upon the frame for movement from a vertical, animal entering and leaving position to a substantially horizontal animal treatment position and vice-versa.

Means are provided on the chassis to move the control box from one position to the other readily and easily.

Another advantage of the present invention although not to be considered limiting, is the fact that a squeeze gate which is provided, can be adjusted so that animals of various sizes can be accommodated within the control box.

Another advantage, once again not to be considered limiting, is the fact that one side of the control box assembly, namely the side which is uppermost when the device is substantially horizontal, includes upper and lower gates which can be opened to provide access to various parts of the animal's body for treatment thereof.

Means may also be provided to hold the animal firmly in place and, if desired, to lift the animal upwardly within the control box prior to moving the control box on its side.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate the corresponding parts in the different figures.

DETAILED DESCRIPTION

Figure 1:
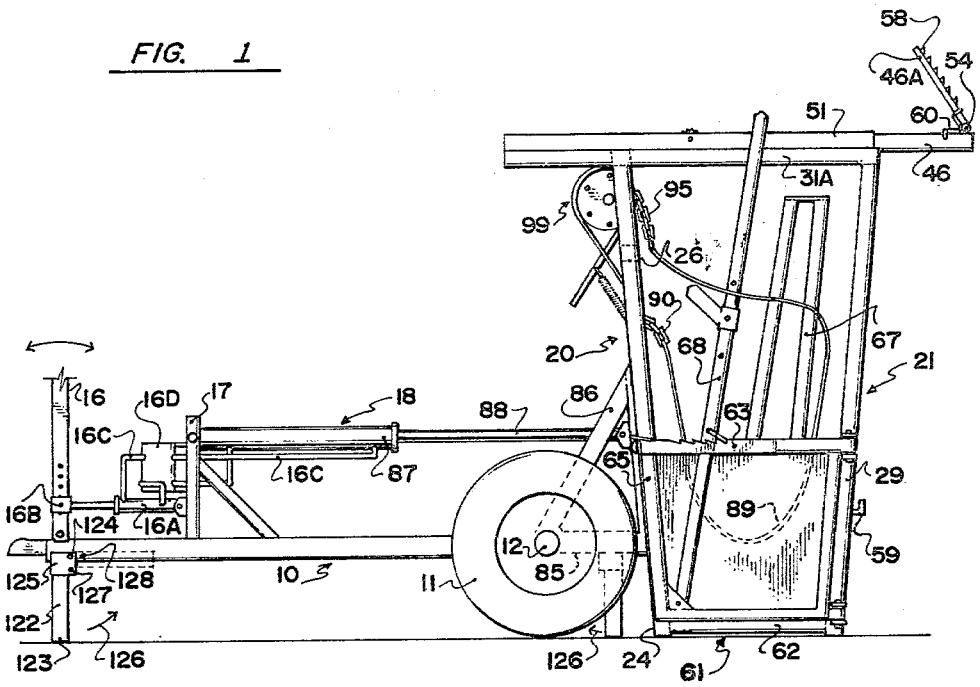
FIG. 1 is a side elevation of the device showing the control box assembly in the vertical or animal entering and leaving position.

Proceeding therefore to describe the invention in detail, reference character 10 illustrates generally, a small trailer having a pair of ground engaging wheels 11 (only one of which is shown) mounted upon the ends of a transverse axle 12. However, it will be appreciated that two stub axles can be provided, if desired.

The frame extends forwardly to a hitch component 13 which is conventional in construction so that it may be readily attached to towing means such as a car, truck or tractor and mounted upon the frame members 14 just rearwardly of the hitch is an hydraulic pump assembly 15 which is conventional, operated in this embodiment, by a hand actuated pump lever 16. The lever is connected to a pump 16A and the connection 16B therewithin can be adjusted to suit various loads as desired.

A bracket 17 extends upwardly from the frame and supports a fluid actuator collectively designated 18, the purpose of which will be hereinafter described. Conventional hose connections 16C extend between the pump assembly 15, the fluid actuator 18 and a reservoir 16D.

The control box collectively designated 19 includes a pair of side frame assemblies collectively designated 20 and 21 respectively. The side frame member 20 is substantially rectangular when viewed in front elevation and is shown in detail in FIG. 5. It consists of a pair of upright members 22 and 23 together with a horizontal lower member 24 and a pair of spaced and parallel horizontal upper members 25 and 26 with vertical stiffening members 27 extending therebetween as clearly shown. The majority of this side is enclosed by panels 28 extending between the horizontal member 26 and the lower member 24.

The side frame assembly 21 includes a front vertical member 29 and a rear vertical member 30 with a horizontal transverse member 31 extending between the upper ends of the front member 29 and the front member 22 of the opposite side frame assembly. A corresponding upper transverse member (not illustrated) extends between the upper ends of the rear members 23 and 30.

The side frame assembly 21 consists of a rolling gate assembly collectively designated 31 and a lower gate assembly collectively designated 32.

The lower gate assembly is substantially rectangular and is closed by means of panels or boards 33. These extend between vertical bracket members 33 and upper and lower frame members 34 and 35.

Figure 8:
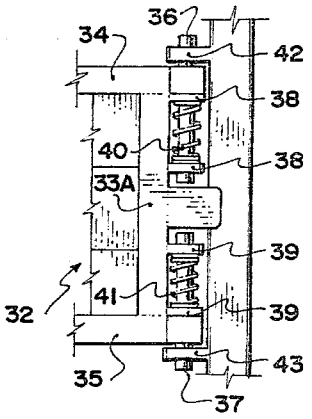
FIG. 8 is a fragmentary enlarged view showing one end of the lower gate attachment to the frame.

The lower gate assembly 32 is detachably mounted within the vertical members 29 and 30 and details of this mounting are shown in FIG. 8.

Horizontal members 34 and 35 extend beyond the vertical member 33 and these horizontal members are vertically secured to slidably receive latch pins 36 and 37. These are mounted between lugs 38 and 39 respectively with compression springs 40 and 41 surrounding the latch pins and normally urging them upwardly and downwardly respectively so that they engage within apertured lugs 42 and 43 respectively extending inwardly from members 29 and 30. The lower gate assembly 32 is normally not disengaged from the frame members 29 and 30 unless difficulty is experienced with an animal held by the control gate assembly. When it is necessary to remove this lower gate assembly, the pins 36 and 37 are retracted against pressure of springs 40 and 41 thus withdrawing the pins from the lugs 42 and 43 and allowing the gate to be removed from the control box assembly.

The rolling gate assembly 31 is substantially rectangular when viewed in front elevation and includes an upper horizontal member 44, a lower horizontal member 45 and vertical members 46 extending therebetween together with diagonal braces 47 as clearly shown.

A shaft 48 is journalled within bearings 49 upon the upper horizontal member 44 and sprockets 50 are secured to the ends of shaft 48. Spanning the upper transverse members 31, at each end of the assembly, are channel members 51 having lengths of sprocket chain 52 secured to the lower flange thereof in the form of a rack and engageable by the sprockets 50 so that the gate is in effect, suspended from these horizontally extending racks. This means that the gate 31 can be pivoted upwardly and rolled across the top of the control box assembly to permit access to the animal held therewithin and FIG. 1 shows this gate partially retracted across the top of the control box.

When in the lowermost or substantially vertical position, inward movement of the upper side of this gate assembly 31 can be restricted by sliding a sleeve 53 along the upper bar 44 to interfere with the rotation of a fixed sprocket 54 secured to shaft 48 thus preventing shaft 48 from rotating.

It should be understood that this upper member 44 at least, should be of square cross section so that the sleeve 55 is nonrotatable thereon.

Figure 6:
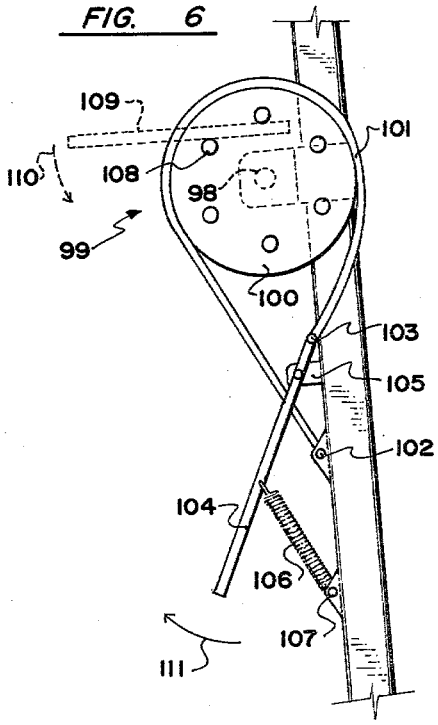
FIG. 6 is a fragmentary end view of the opposite side of the control box showing brake and belt tightening mechanisms.
Figure 9:
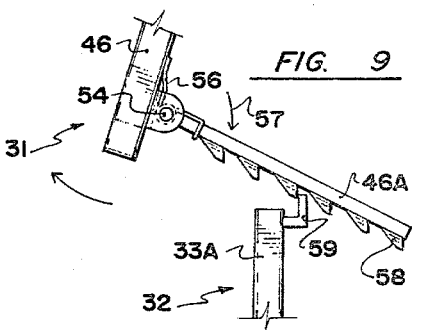
FIG. 9 is a fragmentary end view showing the latching of the rolling gate to the bottom gate.

Means are provided to detachably latch the lower side of the rolling gate assembly 31, to the upper side of the lower gate assembly 32 and details are shown in FIGS. 6 and 9.

A cross bar or shaft 54 is journalled within bearings 55 attached to the lower horizontal bar 45 of the gate assembly 31 and a pair of ratchet levers 46 extend outwardly substantially at right angles from adjacent each end of the bar 54.

Coil springs 56 are secured around the bar 54 and are fixed to adjacent bearings 55 thus normally applying downward pressure in the direction of arrow 57, to the extending ratchet arms 46 which are provided with ratchet teeth 58 on the underside thereof as clearly shown in FIG. 9.

Ratchet engaging lugs 59 extend upwardly from adjacent the upper edge of the lower gate assembly 32 so that as the upper gate 31 moves downwardly, it can be pushed inwardly against the animal with the ratchet bars 46 engaging lugs 59 and holding it in the desired position. When it is desired to release this rolling gate assembly 31, the arms 46 are moved upwardly against pressure of springs 46 thus releasing the gate assembly and enabling same to be rolled to the horizontal position illustrated in FIG. 1. When fully retracted across the top of the control gate assembly, a spring 60 may hook the arm 46 in the position illustrated to keep them clear of the open area.

The rear of the control box is open (not illustrated) to permit access therein by an animal. However the front end is provided with a head squeeze gate assembly collectively designated 61. It consists of a lower horizontal member 62, and an upper horizontal member 63 both extending transversely and parallel to one another and being hinged to one of the vertical frame members 29 by means of hinge pins 64.

A substantially vertical side member 65 is secured to the other ends of the transverse members 62 and 63 as clearly shown. The area confined by the members 62 and 63 and the portions of the members 29 and 65, is enclosed by means of a panel 66. It will also be noted that members 29 and 65 diverge outwardly slightly from the lower ends thereof and that restraining members 67 extend upwardly from the upper transverse member 63 and upon one side thereof. The head squeeze member 68 comprises a bar pivoted by the lower end thereof to adjacent one end of the lower transverse member 62 by means of pivot pin 69. It is also provided with a head hold down lug 70 secured to a sleeve 71 which is movable along the head squeeze member 68 and detachably secured in the desired position by means of a bolt 74 as clearly shown.

A ratchet assembly is provided on the upper transverse member 63 and consists of a ratchet bar 75 spaced from the member 63 between which the head squeeze member may move from side to side. Ratchet lever 76 engages ratchet bar 75 and detachably secures the gate in the closed position against the animal's head being engaged thereby.

Figure 10:
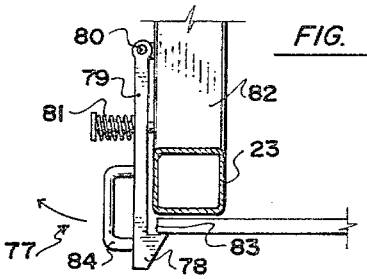
FIG. 10 is a fragmentary top plan view of the front gate latch assembly.

The gate is held in the closed position by an automatic latching assembly collectively designated 77 and shown in detail in FIG. 10. A latch 78 is secured to the end of a latch lever 79 which is pivoted to the side of the side frame by means of pivot pin 80. The spring assembly 81 normally urges latch plate 79 against the frame member 82 so that as the gate is swung shut, the latch engaging side 83 automatically engages the latch and is held thereby. When it is desired to disengage this latch mechanism, handle 84 is used to pull the latch plate outwardly against pressure of spring 81 thus releasing the head squeeze gate from the frame and allowing same to be pivoted to the open position around pivot pin 64.

The upper and lower side gates 31 and 32 provide access for the animal when in the position shown in FIG. 2, it being understood that when in this position, as will hereinafter be described, these side gates will be uppermost.

A plurality of short members 85 extend substantially at right angles from the side frame 20 and are pivotally secured, in this embodiment, to the axle or axle casing 12 with diagonal brace members 86 being provided as shown.

Figure 2:
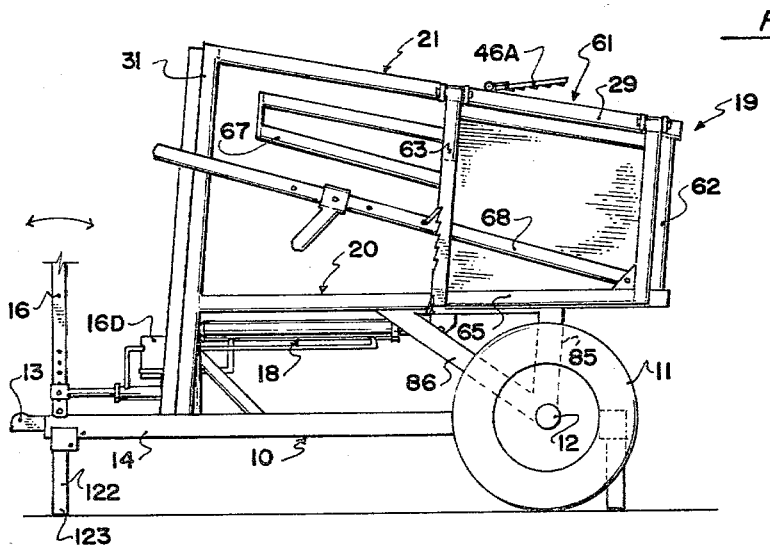
FIG. 2 is a view similar to FIG. 1, but showing the control box in the horizontal or animal treatment position.

This mounts the control box in a pivotal relationship with the trailer thus enabling it to be moved from the animal entering and leaving position shown in FIG. 1, to the substantially horizontal animal treatment position shown in FIG. 2.

Although the control box is shown mounted to the axle or cross member 12 in this embodiment, nevertheless it will be appreciated that it can be pivotally mounted to the trailer by any other convenient means, as desired.

The aforementioned fluid actuator 18 includes a cylinder 87 pivotally secured by one end thereof to the support bracket 17, and a piston rod 88 extending therefrom and being pivotally secured by the distal end thereof to the side frame 20 of the squeeze box 19, substantially intermediate the upper and lower ends thereof as clearly illustrated in FIG. 1.

The hand actuated pump assembly 15 is conventional and is operatively connected to the fluid actuator 18 and incorporates a simple reverse valve system (not illustrated) to either extend or retract the fluid actuator.

When in the extended position shown in FIG. 1, then the control box is substantially vertical and rests upon the ground and when retracted as shown in FIG. 2, the control box is in the horizontal position illustrated.

Means are provided to retain the animal within the control box during the tipping action for treatment purposes or, alternatively, to raise the animal upwardly into the control box if desired.

Figure 13:
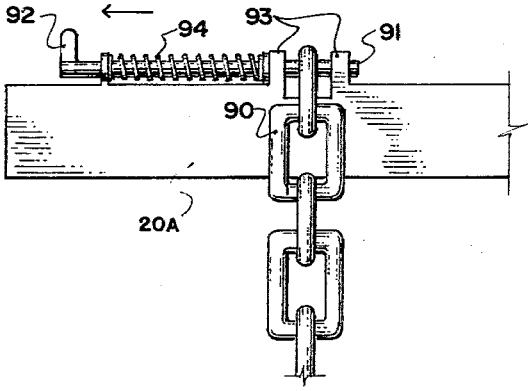
FIG. 13 is a fragmentary view showing anchoring means for the other ends of the belt chains.

For this purpose, a plurality of flexible relatively wide belts 89 are provided. These belts include short lengths of chain 90 on one end thereof detachably securable to anchoring points 91 mounted on the frame and shown in detail in FIGS. 5 and 13. A pin 92 is normally urged into engagement through a pair of spaced and parallel lugs 93, by means of spring 94 with the distal end of the pin engaging one of the chain links 90 which is engaged between the lugs 93 thus giving a certain adjustment if required. Merely by withdrawing pin 92 against pressure of spring 94, releases the chains 90 and hence the belts 89. These are mounted on members 20A across side frame member 20.

Figure 5:
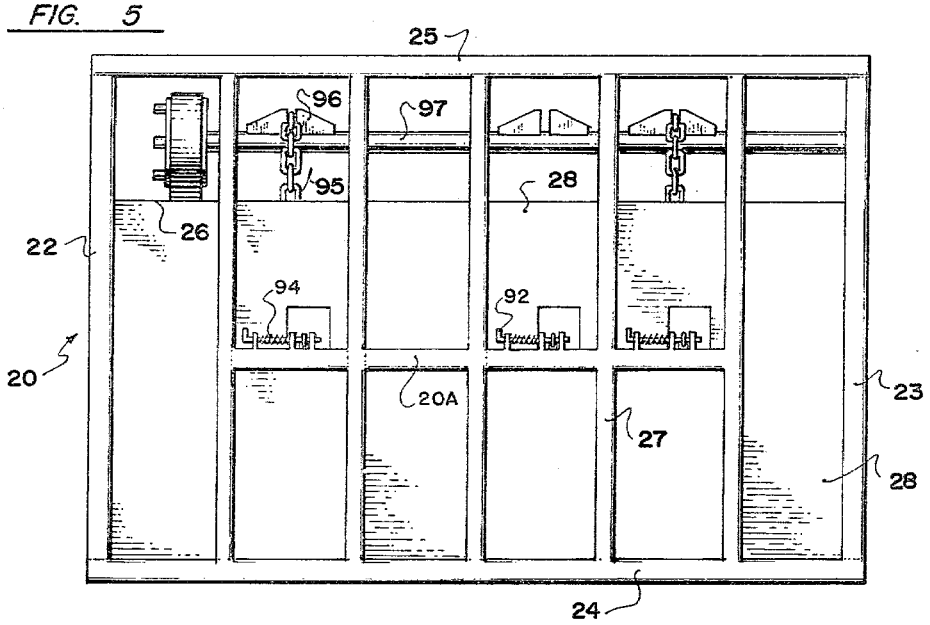
FIG. 5 is a fragmentary view of the opposite side of the control box.
Figure 7:
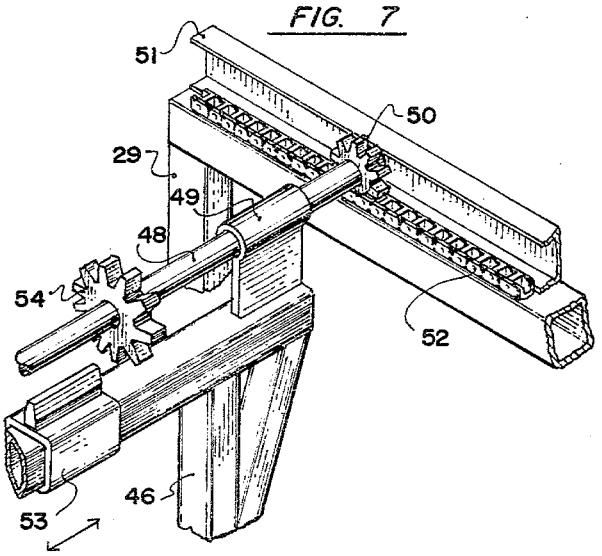
FIG. 7 is a fragmentary isometric view showing one end of the rolling gate side of the control box.

Chain lengths 95 are secured to the opposite ends of the belts 89 and these may be engaged between link retainers 96 secured upon a shaft 97 journalled within bearings 98 secured to the same side frame 20 adjacent the upper side thereof, details of which are illustrated in FIGS. 5 and 6.

A brake drum assembly collectively designated 99 is provided on one end of the shaft 97 and consists of a brake drum 100 with a flexible brake band 101 extending therearound and being anchored by one end thereof as illustrated by reference character 102, to one of the vertical members of the side frame 20 and below the shaft 97.

The other end of the brake band 101 is connected to one end 103 of a lever 104 by means of a pivot pin and this lever is in turn pivoted to a lug 105 extending from the vertical support above the anchor point 102. A heavy-duty spring 106 extends between the lever and a further anchor point 107 on the aforementioned vertical member and normally urges this lever in the downward direction thus tightening the brake band around the brake drum 100.

The brake drum is provided with a plurality of offstanding pins 108 which may be freely engaged by a bar 109 shown in phantom so that the brake drum can be rotated in the direction of arrow 110 thus tightening the belts 89 and supporting the animal within the control box. When being tightened, the lever 104 should be moved upwardly in the direction of arrow 111 in order to release the brake band from the brake drum. As soon as the belts have been tightened sufficiently, release o lever 104 will allow spring 106 to apply the brake anc prevent rotation of the brake drum.

Figure 4:
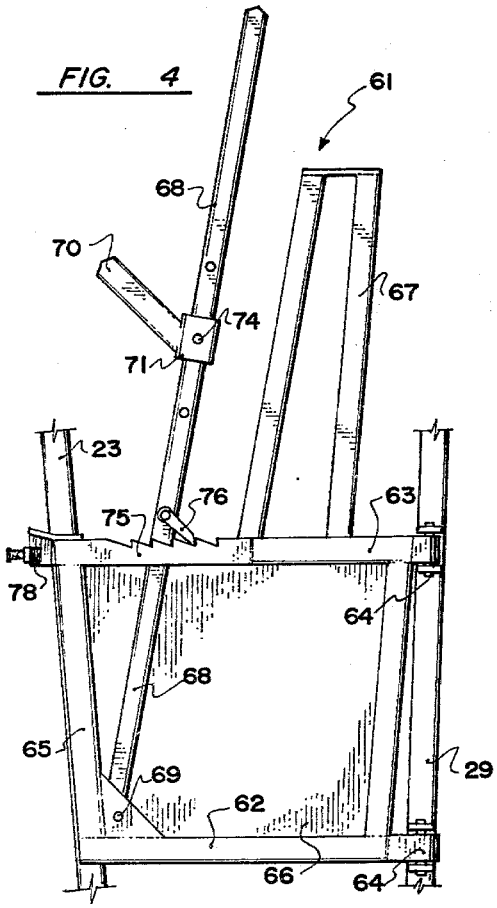
FIG. 4 is an enlarged fragmentary elevational view of part of the head squeeze component and latching mechanism.

In operation, the head squeeze lever 68 is moved to the fully open position towards the restraining bar 67 and the head restraining gate 61 is closed and latched. The upper and lower gates 31 and 32 are closed and the belts are released. The animal is then urged into the enclosure from the rear end thereof so that the head extends between the head restraining bar 68 and the side bar 65 with the lug 70 being above the head and the neck of the animal resting upon the upper transverse bar 63 of the gate 61. The rolling gate assembly 31 is then pushed inwardly and held by the ratchet bars 46 thus restraining the animal from sideways movement within the control box. The head restraining bar 68 is then moved leftwardly with respect to FIG. 4 thus clamping the neck of the animal between the member 65, the member 63, the member 68 and lug 70.

The belts 89 are passed over the animal and back to the lugs 93 and are then tightened to suspend the animal within the control box and to raise same from the ground if necessary. Actuation of the hydraulic pump 16A will retract the fluid actuator 87 and 88 and tilt the squeese box assembly to the position shown in FIG. 2 whereupon the necessary operations may be undertaken.

Figure 3:
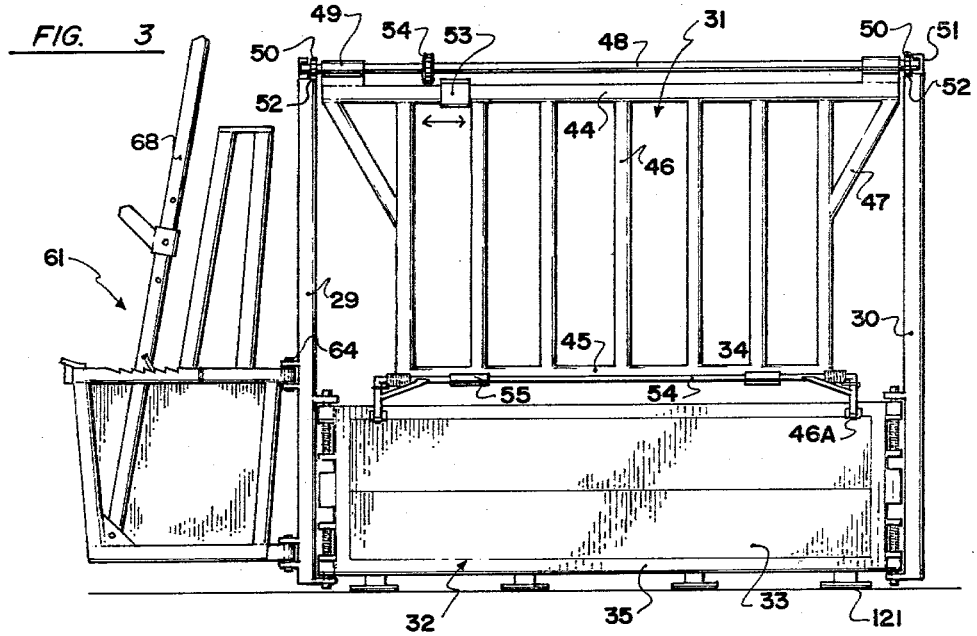
FIG. 3 is a side elevation of the control box per se with the squeeze gate in the open position and showing the upper and lower side gates.

When the necessary treatment has been completed, the control box assembly is returned to the position shown in FIG. 2 whereupon the head squeese bar 68 may be released. The latch assembly 77 is then also released so that the gate may be swung open to the position shown in FIG. 3 whereupon the belts 89 may be released and the animal driven forwardly and out of the control box assembly.

Figure 11:
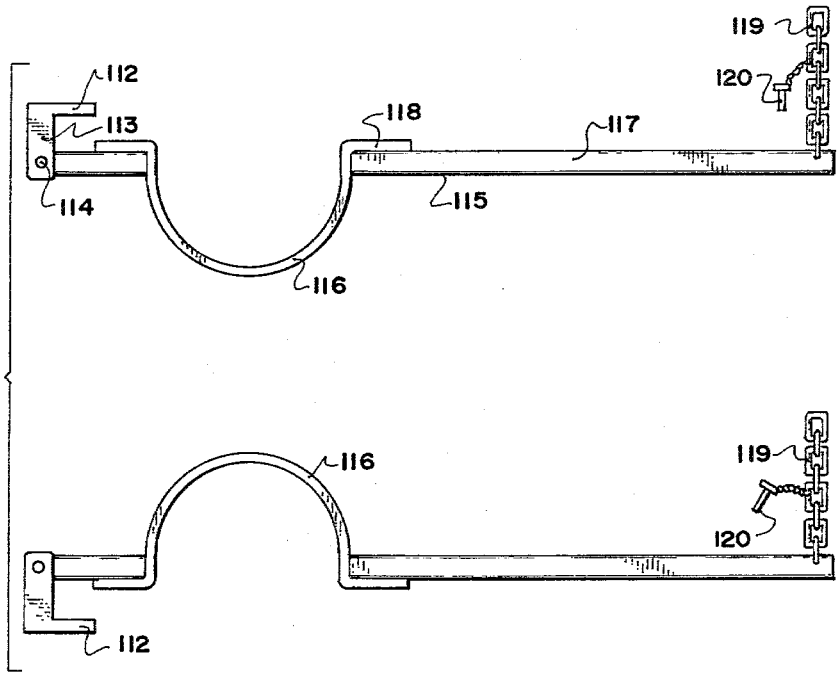
FIG. 11 is a front elevation of a detachable nose holding bar assembly.
Figure 12:
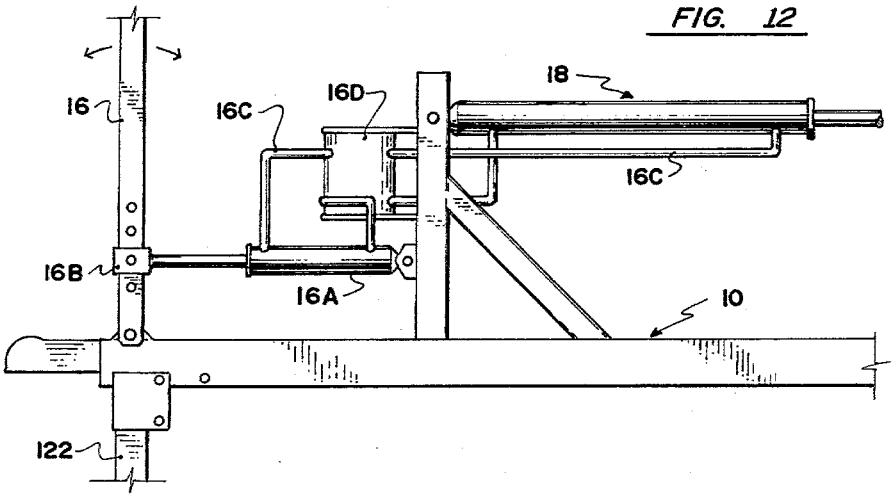
FIG. 12 is a fragmentary enlarged side elevation of the hydraulic pump assembly on the front of the hitch assembly.

If it is necessary to operate on the mouth area or head of the animal, it is sometimes necessary to hold the head still. Under these circumstances, the device illustrated in FIG. 11 is utilized. It consists of a horizontal cylindrical bar 112 engageable within a short tube 113 on the vertical member of the side frame 20 adjacent the latch mechanism 77. A portion 113 extends at right angles and the distal end of this portion acts as a pivot 114 for the main clamp arm 115. This consists of an arcuately curved portion 116 and an actuated handle portion 117 with a flat plate 118 secured from adjacent the pivot 114 to just beyond the junction of the arcuate portion 116 with the handle 117. This engages over the upper jaw and nose area of the animal and holds same against the upper transverse bar 63 of the head squeeze gate assembly 61. A chain 119 with pin 120, may be engaged within an aperture 59 on vertical member 29 to hold the assembly in position upon the animal's nose thus holding the head still for treatment purposes.

It should be noted that small members 121 are provided adjacent each lower corner of the two sides frames to enable the animal's legs to be lashed to these corners if desired.

If the device is being used on a relatively flat surface such as a concrete floor, and detached from a towing means, then folding legs 122 may be utilized to stabilize the structure. These legs are situated one upon each side of the frame rearwardly of the wheels 11 and just behind the hitch 13. They each consist of a member 123 pivoted to the frame by means of pivot pins 124 by means of upstanding flanges 125, it being understood that the legs are preferably formed from channel members. This means that when they are in the lowered position shown in FIG. 1, they are restricted from further rearward movement by the engagement of part of the flange with the underside of the frame structure (not illustrated).

However when it is desired to fold same upwardly, they may be folded upwardly to the frame in the direction of arrow 126 whereupon a pin (not illustrated) may engage an aperture 127 in the leg and an aperture 128 in the frame thus retaining them in the uppermost position shown in phantom in FIG. 1.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. An animal control box assembly comprising in combination a wheeled trailer, including a frame, a hitch on the front end of said frame, and a control box pivotally mounted upon said frame for movement from a vertical, animal entering and leaving position, to a substantially horizontal animal treatment position and vice-versa, and means on said frame to move said control box from one position to the other, said control box assembly including a pair of side frames and a head squeeze gate at one end of said side frames, said head squeeze gate being hinged to one of said side frames and detachably latchable to the other of said side frames, one of said side frames including an upper gate section hingedly secured by the upper side thereof to the upper edge of said one side frames and a lower gate section detachably secured by the lower side thereof to the lower edge of said one said frame, and detachable latch means securing said upper gate section to said lower gate section.

2. The assembly according to claim 1 in which said trailer frame includes a transverse axle component extending therebetween, ssid control box being pivotally mounted upon said axle component.

3. The assembly according to claim 1 in which said last mentioned means includes a fluid operator, operatively extending between said trailer and said control box.

4. The assembly according to claim 3 in which said trailer frame includes a transverse axle component extending therebetween, said control box being pivotally mounted upon said axle component.

5. The assembly according to claim 2 in which said fluid operator includes a hand operated hydraulic pump assembly operatively connected to said fluid operator.

6. The assembly according to claim 5 in which said trailer frame includes a transverse axle component extending therebetween, said control box being pivotally mounted upon said axle component.

7. The assembly according to claims 1, 3 or 5 which includes means mounting said upper gate section to said control box for upward swinging action and retraction across the top of said control box when in the open position, said means including a shaft journalled for rotation along the outer side of said upper gate section, rack tracks extending horizontally and transversely across the upper side of said control box, rack engaging gears secured to said shaft and engaging said tracks, means to retain said gears in engagement with said tracks and means to detachably lock said shaft against rotation when said gate section is in the closed position.

8. The assembly according to claims 2, 4 or 6 which includes means mounting said upper gate section to said control box for upward swinging action and retraction across the top of said control box when in the open position, said means including a shaft journalled for rotation along the outer side of said upper gate section, rack tracks extending horizontally and transversely across the upper side of said control box, rack engaging gears secured to said shaft and engaging said tracks, means to retain said gears in engagement with said tracks and means to detachably lock said shaft against rotation when said gate section is in the closed position.

* * * * *